US006878915B1

(12) United States Patent
Hern-Fonseth et al.

(10) Patent No.: US 6,878,915 B1
(45) Date of Patent: Apr. 12, 2005

(54) AIR FLOW SYSTEM FOR MICROWAVE COOKING APPLIANCE

(75) Inventors: Valerie L. Hern-Fonseth, Hixson, TN (US); Trieu Huynh, Ooltewah, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/829,379

(22) Filed: Apr. 22, 2004

Related U.S. Application Data

(60) Provisional application No. 60/554,367, filed on Mar. 19, 2004.

(51) Int. Cl.[7] ..... H05B 6/80

(52) U.S. Cl. ..... 219/757; 219/400; 126/21 A

(58) Field of Search ..... 219/757, 756, 219/686, 400, 681, 683; 126/21 A, 299 R, 21 R, 39 R, 110 R, 237 R, 273 R, 198

(56) References Cited

U.S. PATENT DOCUMENTS

| | | | | |
|---|---|---|---|---|
| 3,681,557 A | | 8/1972 | Suzuki et al. | |
| 4,123,643 A | | 10/1978 | Burke | |
| 4,743,728 A | * | 5/1988 | Nagafusa et al. | 219/757 |
| 5,235,148 A | * | 8/1993 | Yamaguchi et al. | 219/707 |
| 5,814,793 A | | 9/1998 | Yu | |
| 5,945,023 A | | 8/1999 | Yang | |
| 5,981,929 A | | 11/1999 | Maeda et al. | |
| 6,127,666 A | * | 10/2000 | Sohn | 219/757 |
| 6,344,637 B1 | | 2/2002 | Lee et al. | |
| 6,369,372 B1 | * | 4/2002 | Kim | 219/756 |
| 6,528,774 B1 | | 3/2003 | Lee | |
| 2002/0084269 A1 | | 7/2002 | Kim | |

FOREIGN PATENT DOCUMENTS

| | | |
|---|---|---|
| JP | 02-144220 | 6/1991 |
| JP | 06-249449 | 9/1994 |

* cited by examiner

*Primary Examiner*—Quang T Van
(74) *Attorney, Agent, or Firm*—Diederiks & Whitelaw, PLC

(57) ABSTRACT

An airflow system of a cooking appliance having an oven cavity includes an intake portion, an exhaust portion and a diverter portion. The intake portion introduces an airflow into the cooking appliance that diverges into first and second airstreams. The first airstream enters the oven cavity and picks up moisture from food items being cooked, while the second airstream circulates outside the oven cavity. The diverter member guides the second airstream to mix with the first airstream at a predetermined region outside the oven cavity to transport the moisture through the exhaust portion and away from the cooking appliance. Preferably, the diverter member extends fore-to-aft below the oven cavity and includes a plurality of openings.

28 Claims, 5 Drawing Sheets

AIR FLOW SYSTEM FOR MICROWAVE COOKING APPLIANCE

CROSS-REFERENCE TO RELATED APPLICATIONS

The present application claims the benefit of U.S. Provisional Patent Application Ser. No. 60/554,367 filed Mar. 19, 2004.

BACKGROUND OF THE INVENTION

1. Field of the Invention

The present invention pertains to the art of cooking appliances and, more particularly, to an airflow system designed to eliminate potential moisture condensation associated with operation of a microwave cooking appliance.

2. Discussion of the Prior Art

During a typical cooking operation, a food item is placed into an oven cavity to be subjected to cooking temperatures. The cooking temperatures cause moisture contained in food items to be released into the oven cavity. This is particularly true in the case of microwave cooking. A microwave cooking operation is performed by directing microwave energy fields into an oven cavity, with the energy fields reflecting about and impinging upon a food item. As the microwave energy fields impinge upon the food item, the energy fields are converted into heat through two mechanisms. The first or ionic mechanism is caused by the linear acceleration of ions, generally in the form of salts present within the food item. The second is the molecular excitation of polar molecules, primarily water, present within the food item.

The excitation of polar molecules causes the water or moisture to be released into the oven cavity. The moisture can either condense within the oven cavity or be carried by air currents circulating in the oven cavity to a point outside the oven cavity. If the air currents are not sufficient enough to carry the moisture from the appliance, the moisture exiting from the oven cavity could condense on ducting or other structure employed to guide the air currents from the appliance. Moisture building up within the ducting or other structure will ultimately find a path that leads from the appliance. Obviously, developed moisture could cause damage to surrounding cabinetry or to control components of the overall appliance. This is particularly true in connection with a double wall oven incorporating control components directly below an oven cavity.

Several attempts to address this problem are found in the prior art. In one example, contained in U.S. Pat. No. 5,945,023, a number of holes are formed in a lower portion of a side wall of an oven cavity. The holes allow moisture to escape from the oven cavity and be directed through a bottom portion of the appliance. In another example proposed in U.S. Pat. No. 4,123,643, a first air current is directed past a magnetron before being introduced into the oven cavity to mix with a second air current. The combined air currents absorb moisture and are then directed out of a front portion of the oven cavity.

Despite the existence of the prior art arrangements, there still exists a need for an airflow system that will carry moisture away from a microwave cooking appliance in a manner that will assure that surrounding structure will not be negatively affected by the moisture. Specifically, there exists a need for an airflow system that will transport moisture laden air outside the oven cavity so that the moisture does not build-up, condense and drip on surrounding cabinetry or other appliance structure.

SUMMARY OF THE INVENTION

The present invention is directed an airflow system for a microwave cooking appliance. The cooking appliance includes a frame that supports an oven cavity. The airflow system is designed to direct an airflow both into and about the oven cavity. Toward that end, the airflow system includes an intake portion for introducing an ambient airflow into the cooking appliance. After entering through the intake portion, the ambient airflow diverges into a first airstream that is directed into the oven cavity and a second airstream that is directed at least beneath the oven cavity. The first airstream picks up moisture that is released by one or more food items during a cooking operation. The first airstream then exits the oven cavity to define an exhaust airstream that is directed to a lower portion of the cooking appliance.

The second airstream is directed beneath the oven cavity in order to cool components of the cooking system, such as a turntable motor. In accordance with the invention, a diverter is employed to assure that the second airstream is directed to merge with the first airstream at a predetermined region outside the oven cavity. With this arrangement, the second airstream mixes with the first airstream to carry the moisture away from the predetermined location and out of the appliance.

In accordance with the most preferred form of the invention, the diverter is positioned below the oven cavity and extends generally fore-to-aft across the frame. More specifically, the diverter includes a first end, positioned at a front section of the frame, that extends, through an intermediate portion, to a second end positioned at a rear section of the frame. The first end of the diverter is provided with a passage zone that allows the second airstream to enter and mix with the first airstream at the predetermined region. The passage is preferably formed by one or more openings, with or without louvers, that guide the second airstream toward the predetermined region beneath the oven cavity. With this arrangement, the second airstream combines with the first airstream to carry moisture, picked-up by the first airstream from the oven cavity, to exhaust outlets and away from the cooking appliance. Therefore, the moisture will not be able to condense into water droplets that can cause damage to surrounding cabinetry or other cooking appliance structure.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENTS

Figure 1:
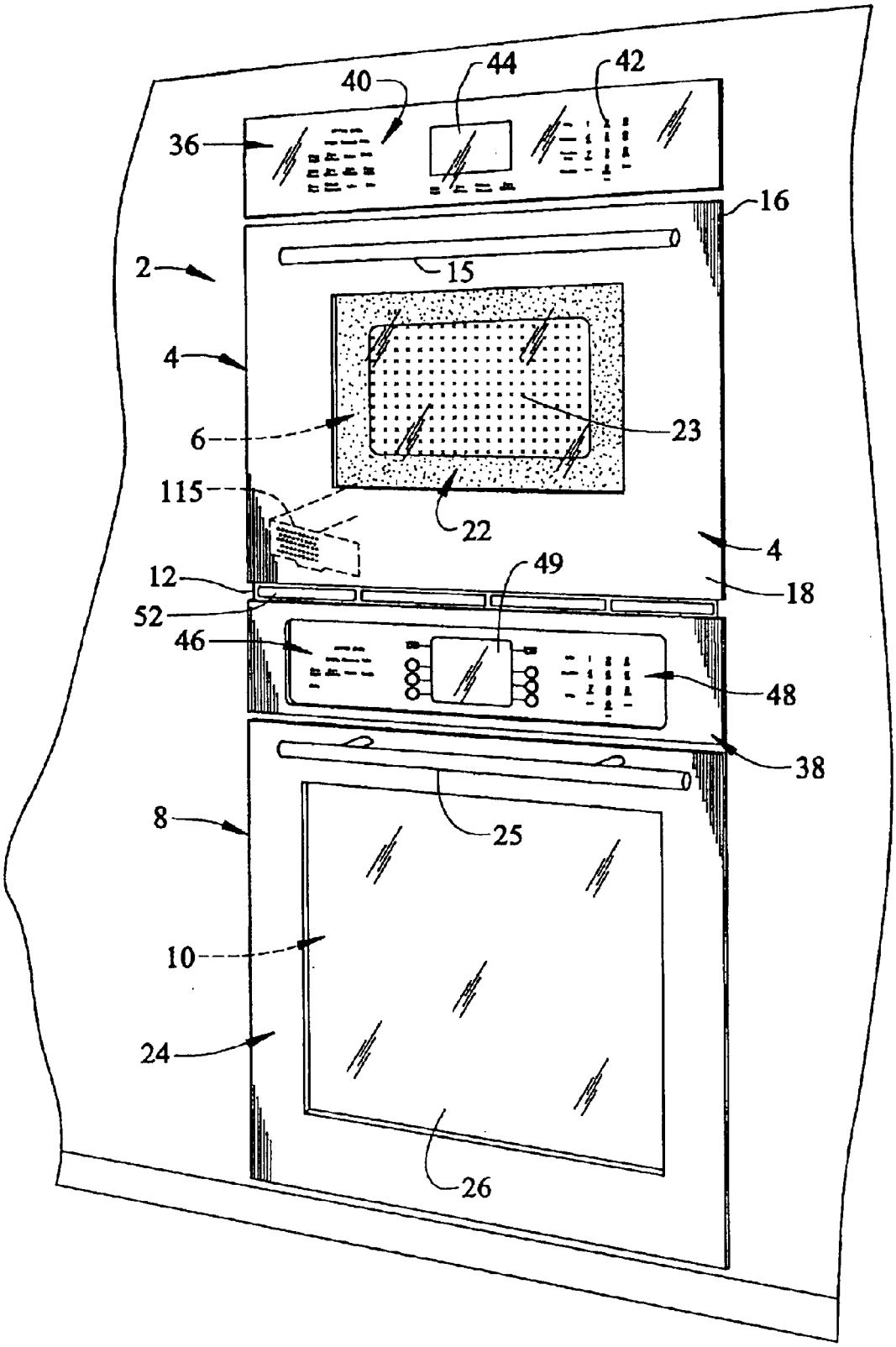
FIG. 1 is a partial perspective view of a dual oven cooking appliance having an upper microwave oven constructed in accordance with the present invention and a lower radiant-type oven.

With initial reference to FIG. 1, a cooking appliance constructed in accordance with the present invention is generally indicated at 2. As depicted, cooking appliance 2 constitutes a double wall oven. However, as will become more readily apparent below, the present invention is not limited to this model type and can be incorporated into other oven configurations. In any event, in the embodiment shown, cooking appliance 2 constitutes a double wall oven including an upper oven 4 having an upper oven cavity 6 and a lower oven 8 having a lower oven cavity 10. Cooking appliance 2 includes a frontal frame, part of which is indicated at 12, to which both upper and lower oven cavities 6 and 10 are connected.

A door 14 is provided to selectively access upper oven cavity 6. As shown, door 14 includes an elongated handle 15 at an upper portion 16. Door 14 is adapted to pivot at a lower portion 18 to enable selective access to within oven cavity 6. Door 14 is provided with a transparent zone or window 22 for viewing the contents of oven cavity 6 while door 14 is closed. In accordance with the invention, upper oven 4 constitutes a microwave oven. To this end, window 22 preferably incorporates a microwave choke screen portion 23. In a corresponding manner, a door 24, including an elongated handle 25 and a transparent zone or window 26, is provided to selectively access lower oven cavity 10. In the preferred embodiment, lower oven 8 constitutes a radiant or conbination radiant/convection oven.

As further shown in FIG. 1, cooking appliance 2 includes an upper control panel 36 and a lower control panel 38. Upper control panel 36 is provided with a plurality of control elements generally indicated at 40, a numeric keypad 42 and a display 44. In general, control elements 40, keypad 42 and display 44 enable a user to establish desired cooking operations for upper oven 4. In a similar manner, lower control panel 38 is provided with a plurality of control elements 46, a numeric keypad 48 and a display 49 for establishing desired cooking operations within lower oven 8. Since the particular manner in which upper and lower ovens 4 and 8 are programmed does not constitute part of the present invention, further details thereof will not be discussed herein. Finally, cooking appliance 2 is shown to include a plurality of exhaust outlets, one of which is labeled 52, arranged between door 14 and lower control panel 38.

Figure 2:
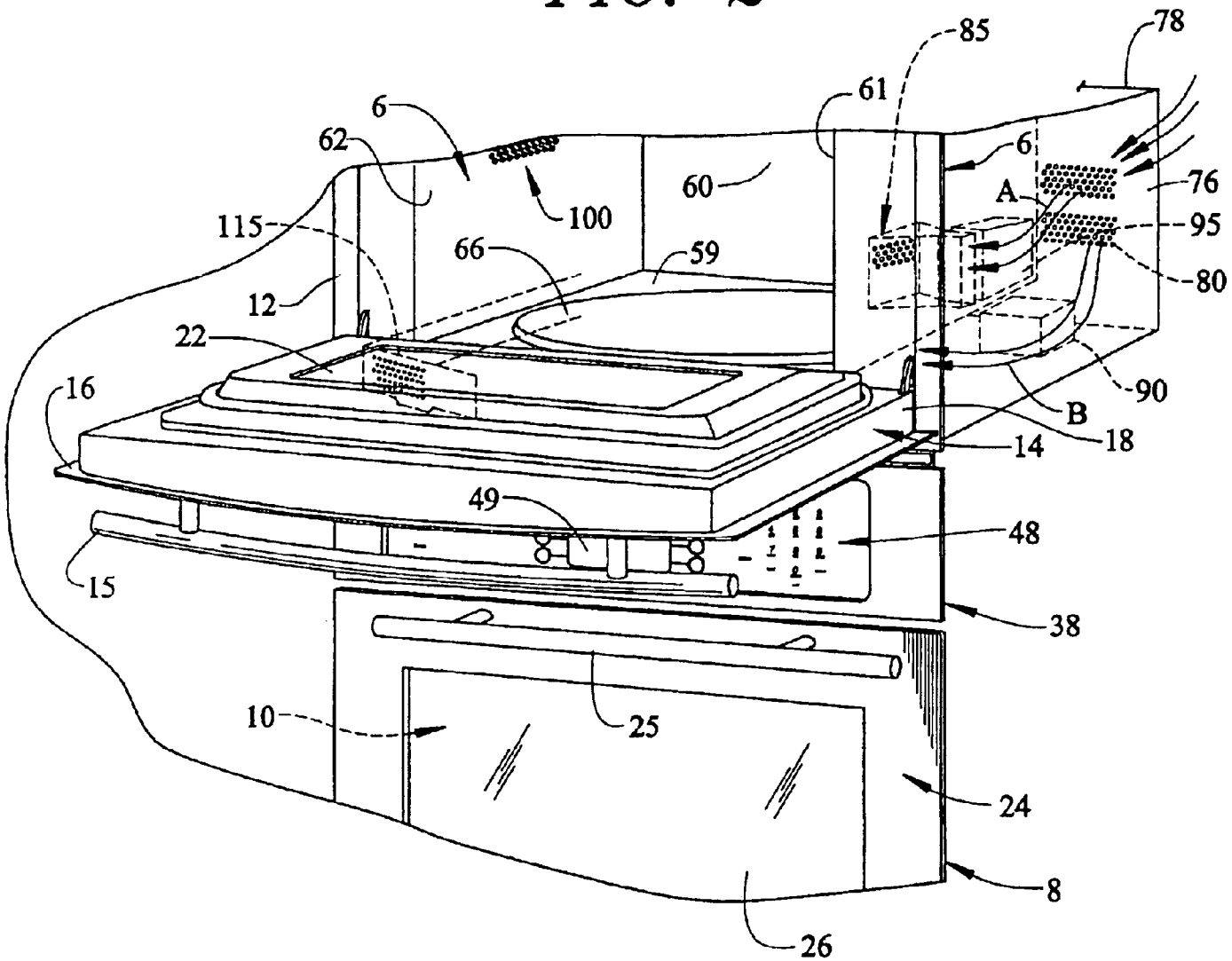
FIG. 2 is a partial perspective view of the cooking appliance of FIG. 1, with a door for the upper microwave oven shown in an open position.

As indicated above, upper oven 4 in accordance with the invention constitutes a microwave oven. With particular reference to FIG. 2, oven cavity 6 of upper or microwave oven 4 is defined by a bottom wall 59, a rear wall 60, opposing side walls 61 and 62, and a top wall (not shown). Bottom wall 59 is constituted by a substantially flat, smooth surface to enhance cleanability of oven cavity 6. However, oven cavity 6 is shown to include a rotatable platter or turntable 66 provided across a portion of bottom wall 59, with turntable 66 being rotatably driven by a motor 69 arranged beneath upper oven cavity 6 (see FIG. 3). As also depicted in FIG. 2, upper oven 4 further defines at least one side panel 76 and a rear panel 78. As indicated in FIG. 2, rear panel 78 is provided with a plurality of openings 80 that define an intake zone for introducing a stream of ambient air employed in connection with operation of upper oven 4. As will be detailed more fully below, the air stream entering intake openings 80 diverges into a first air stream that is directed into upper oven cavity 6 through inlet openings 85 provided in side wall 61 and a second air stream that is directed beneath upper oven cavity 6.

More specifically, with further reference to FIG. 2, the ambient air flow introduced through intake openings 80 is divided into a first air stream A that flows over certain power control components, such as a transformer 90 and then flows through a magnetron 95 into upper oven cavity 6 through inlet openings 85, and a second air stream B. First air stream A then flows within upper oven cavity 6 and is led to outlet openings 100 provided in side wall 62 of upper oven cavity 6. First air stream A is then directed between side wall 62 and a side panel 104 of cooking appliance 2 to a position beneath upper oven cavity 6.

Due to the operation of upper oven 4, first air stream A will pickup moisture within upper oven cavity 6 during a cooking operation. If left unchecked, the moisture in first air stream A could condense, particularly adjacent the lower front left corner of door 14. As lower control panel 38 is located directly below door 14, any condensation in this region could have an adverse effect on the associated electronics. In accordance with the present invention, this potential concern is addressed by assuring that the moisture-laden first air stream A is mixed with second air stream B prior to reaching exhaust outlets 52 as will be detailed fully below.

Figure 3:
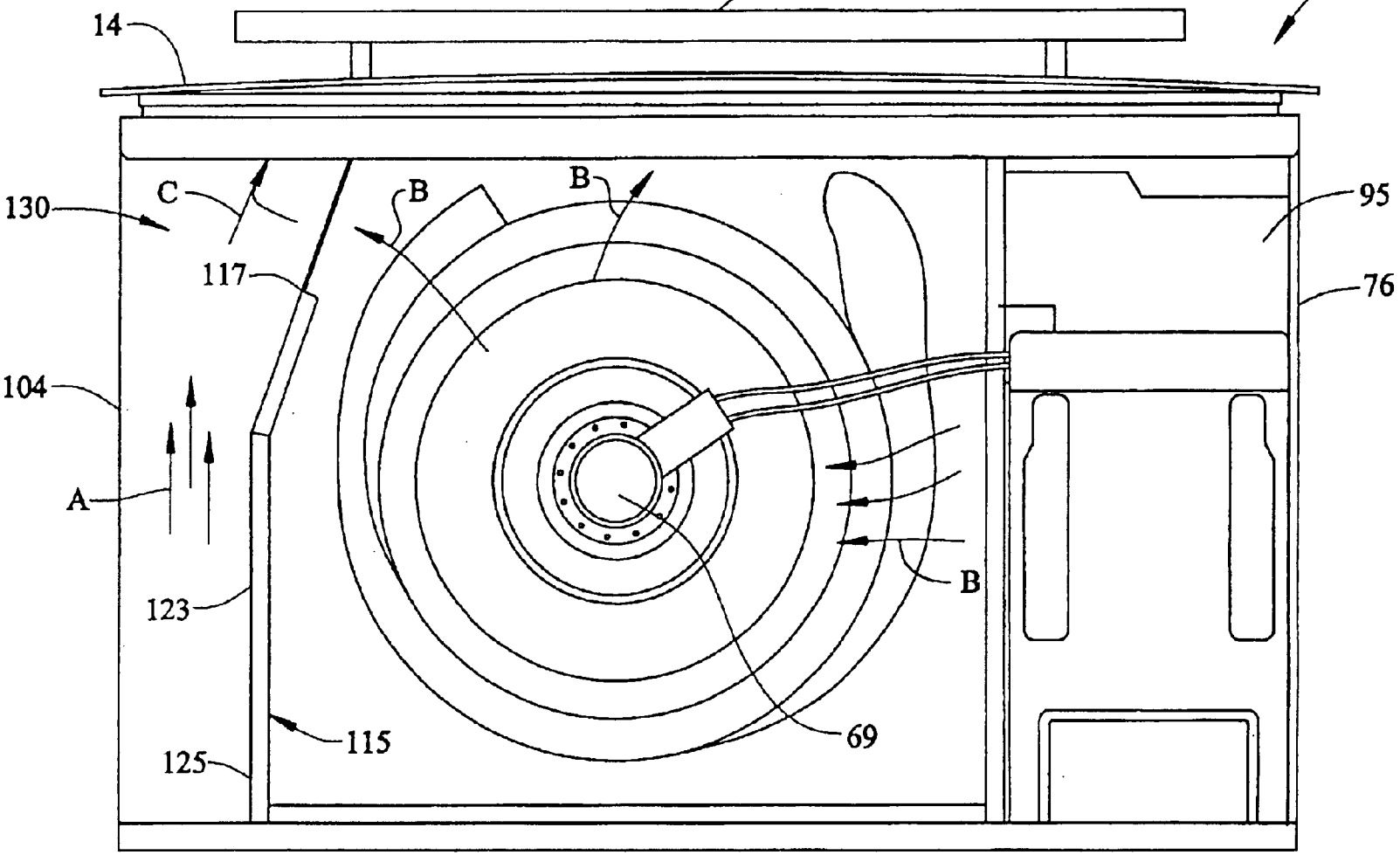
FIG. 3 is a bottom plan view of the upper microwave oven of FIGS. 1 and 2, with a lower panel removed.
Figure 4:
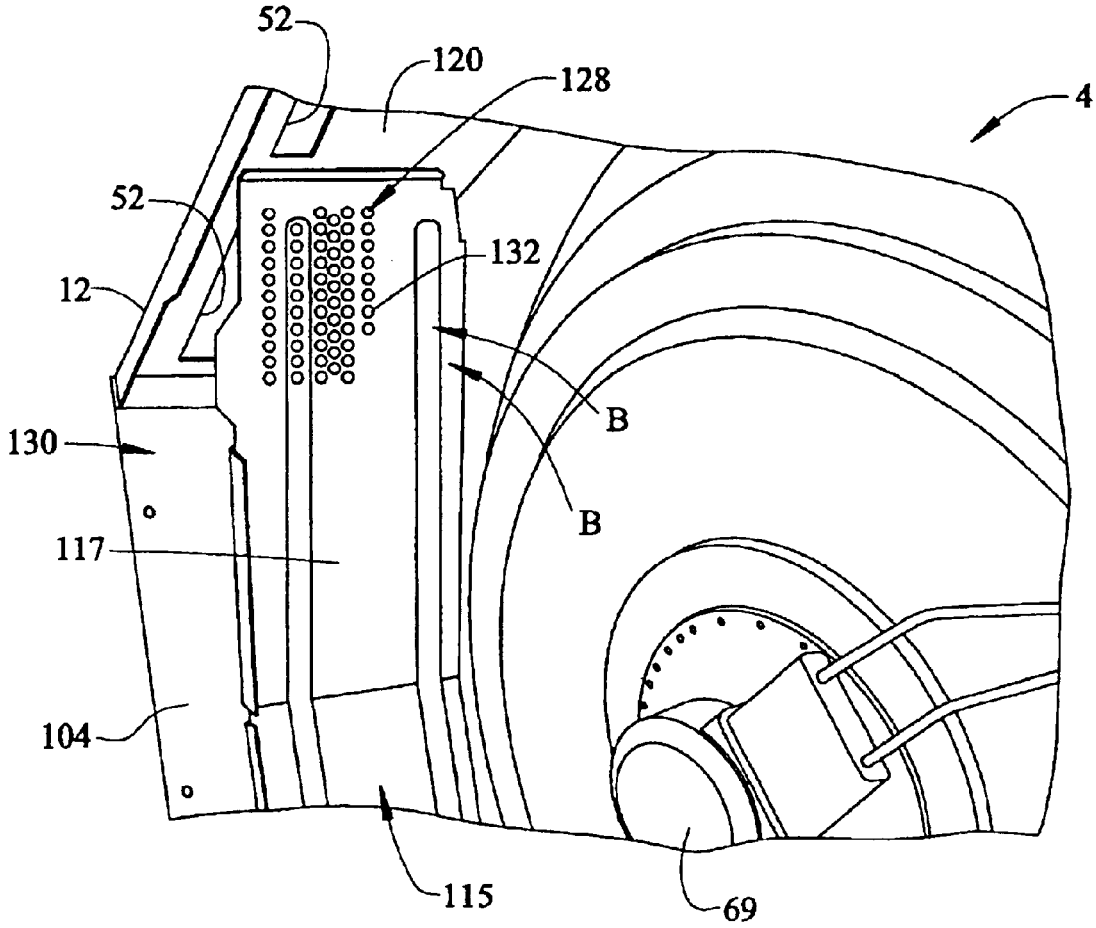
FIG. 4 is an enlarged, partial view of an underside of the upper microwave oven of FIG. 1, illustrating an airflow diverter plate including a plurality of round openings constructed in accordance with a first embodiment of the present invention.

With particular reference to FIGS. 3 and 4, second air stream B is directed beneath upper oven cavity 6 and across motor 69 for turntable 66. Instead of simply being able to freely flow out exhaust outlets 52, second air stream B encounters a diverter 115. In the most preferred form of the invention, diverter 115 includes a first end portion 117 positioned at a frontal section 120 of cooking appliance 2, an intermediate portion 123 and a second end portion 125 positioned at a rear section (not labeled) of cooking appliance 2. Diverter 115 is preferably constituted by a plate which is solid throughout intermediate portion 123 and second end portion 125. However, first end portion 117 is provided with a plurality of openings 128 that define a passage zone. In accordance with the most preferred embodiment of the invention, first end portion 117 is actually angled relative to intermediate portion 123 and second end portion 125 as clearly shown in these figures. In any case, given that only first end portion 117 is provided with openings 128, at least a portion of second air stream B is forced to exit from beneath upper oven cavity 6 at the lower front left corner, generally indicated 130, of upper oven 4. First air stream A exiting upper oven cavity 6 through outlet openings 100 must also flow through lower front left corner region 130. Therefore, second air stream B will mix with first air stream A at predetermined region, i.e., the lower front left corner in the preferred embodiment disclosed, thereby forming mixed air stream C outside upper oven cavity 6. The mixing of second air stream B with first air stream A in this manner assures that the moisture originally present in first air stream A will be directed through at least one of exhaust outlets 52 and away from cooking appliance 2.

Figure 5:
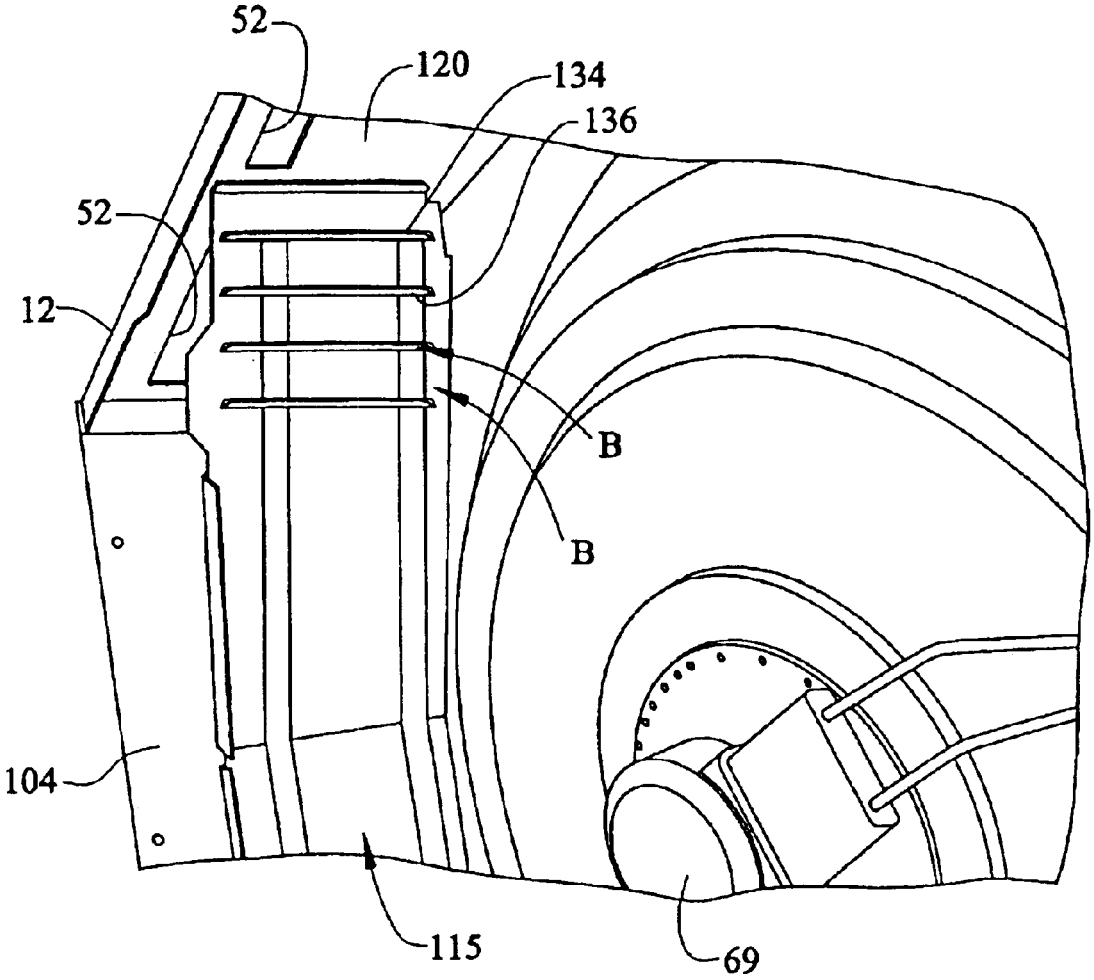
FIG. 5 is an enlarged, partial view of an underside of the upper microwave oven of FIG. 1 illustrating an airflow diverter plate including a plurality of louvered openings constructed in accordance with a second embodiment of the present invention.
Figure 6:
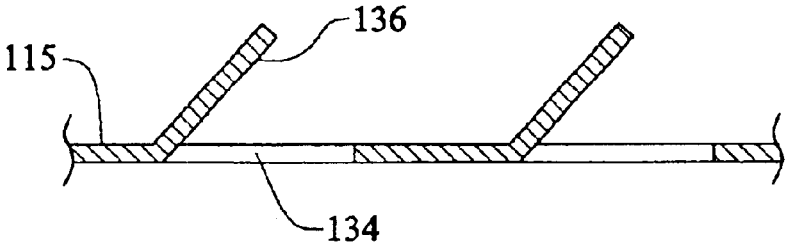
FIG. 6 is a partial cross-sectional view of the louvers of FIG. 5.

Based on the above, it should be readily apparent that the inclusion of diverter 115 controls the flow of second air stream B which, in turn, alters the flow of first air stream A. This arrangement has been found to eliminate any moisture build-up that could condense and drip onto lower control panel 38. Of course, the exact positioning and structure of diverter 115 will depend upon the exhaust path for first air stream A and the positioning of exhaust outlets 52 for cooking appliance 2. In accordance with the invention, openings 128 in diverter 115 can take various forms, including a plurality of circular holes 132 as shown in the embodiment of FIG. 3, and slotted openings 134 having associated louvers 136 as shown in the embodiment of FIGS. 4 and 5. In any case, openings 128 assure that first and second air streams A and B will mix at a predetermined region in order to prevent undesirable condensation of moisture leaving upper oven cavity 6 during cooking operations.

Although described with reference to preferred embodiments of the present invention, it should be readily apparent to one of ordinary skill in the art that various changes and/or modifications can be made to the invention without departing from the spirit thereof. For instance, although the mixing of the first and second air streams have been disclosed to particularly prevent condensation from forming on the lower control panel, the invention is applicable in other types of cooking appliances and can be used to protect cabinetry or other structure adjacent the appliance. In general, the invention is only intended to be limited by the scope of the following claims.

We claim:

1. A cooking appliance comprising:

an oven cavity including top, bottom, rear and opposing side walls, as well as an open frontal opening;

a door mounted for movement relative to the oven cavity, said door being adapted to selectively extend across the frontal opening or enable access to the oven cavity;

a magnetron positioned to direct a microwave energy field into the oven cavity to perform a cooking operation;

a control panel including a plurality of control elements for establishing the cooking operation in the oven cavity; and an airflow system for establishing an airflow for the cooking appliance including:

an intake portion for introducing an ambient airflow into the cooking appliance, said ambient airflow establishing a first airstream directed into the oven cavity and a second airstream directed outside the oven cavity;

an exhaust portion for enabling the first and second airstreams to exit the cooking appliance; and a diverter member guiding the second airstream to mix with the first airstream, approximately at the exhaust portion, at a predetermined region outside the oven cavity, wherein moisture carried by the first airstream is carried out through the exhaust portion and away from the cooking appliance.

2. The cooking appliance according to claim 1, wherein the diverter member extends substantially fore-to-aft below the oven cavity.

3. A cooking appliance comprising:

an oven cavity including top, bottom, rear and opposing side walls, as well as an open frontal opening;

a door mounted for movement relative to the oven cavity, said door being adapted to selectively extend across the frontal opening or enable access to the oven cavity;

a magnetron positioned to direct a microwave energy field into the oven cavity to perform a cooking operation;

a control panel including a plurality of control elements for establishing the cooking operation in the oven cavity; and an airflow system for establishing an airflow for the cooking appliance including:

an intake portion for introducing an ambient airflow into the cooking appliance, said ambient airflow establishing a first airstream directed into the oven cavity and a second airstream directed outside the oven cavity;

an exhaust portion for enabling the first and second airstreams to exit the cooking appliance; and a diverter member guiding the second airstream to mix with the first airstream, prior to the exhaust portion, at a predetermined region outside the oven cavity, wherein moisture carried by the first airstream is carried out through the exhaust portion and away from the cooking appliance, wherein said diverter member extends substantially fore-to-aft below the oven cavity and includes a first end portion positioned at a front section of the cooking appliance, a second end portion arranged at a rear section of the cooking appliance, and an intermediate portion interconnecting the first and second end portions.

4. The cooking appliance according to claim 3, further comprising: at least one opening formed in the first end portion of the diverter member for passage of the second airstream through the diverter member.

5. The cooking appliance according to claim 4, wherein the at least one opening is constituted by a plurality of round openings.

6. The cooking appliance according to claim 4, wherein the at least one opening is constituted by a plurality of louvers.

7. The cooking appliance according to claim 4, wherein the second airstream is guided through the at least one opening prior to mixing with the first airstream.

8. The cooking appliance according to claim 4, wherein the first end portion of the diverter member is angled with respect to at least the second end portion.

9. The cooking appliance according to claim 1, further comprising:

a turntable located in the oven cavity; and a motor mounted below the oven cavity for rotating the turntable, said second airstream flowing across the motor.

10. The cooking appliance according to claim 1, further comprising: a second oven cavity located below said oven cavity, said control panel being located vertically between the oven cavity and said second oven cavity, wherein the moisture is directed away from the control panel.

11. The cooking appliance according to claim 1, wherein the predetermined region is located at a front corner portion of the cooking appliance.

12. A cooking appliance comprising:

an oven cavity including top, bottom, rear and opposing side walls, as well as an open frontal opening;

a door mounted for movement relative to the oven cavity, said door being adapted to selectively extend across the frontal opening or enable access to the oven cavity;

a magnetron positioned to direct a microwave energy field into the oven cavity to perform a cooking operation;

a control panel including a plurality of control elements for establishing the cooking operation in the oven cavity; and an airflow system for establishing an airflow for the cooking appliance including:

an intake portion for introducing an ambient airflow into the cooking appliance, said ambient airflow establishing a first airstream directed into the oven cavity and a second airstream directed outside the oven cavity;

an exhaust portion for enabling the first and second airstreams to exit the cooking appliance; and means for guiding the second airstream to mix with the first airstream, approximately at the exhaust portion, at a predetermined region outside the oven cavity, wherein moisture carried by the first airstream is carried out through the exhaust portion and away from the cooking appliance.

13. The cooking appliance according to claim 12, wherein the diverter means extends substantially fore-to-aft below the oven cavity.

14. The cooking appliance according to claim 13, wherein said diverter means includes a first end portion positioned at a front section of the cooking appliance, a second end portion arranged at a rear section of the cooking appliance, and an intermediate portion interconnecting the first and second end portions.

15. The cooking appliance according to claim 14, further comprising: at least one opening formed in the first end portion of the diverter means for passage of the second airstream through the diverter means.

16. The cooking appliance according to claim 15, wherein the at least one opening is constituted by a plurality of round openings.

17. The cooking appliance according to claim 15, wherein the at least one opening is constituted by a plurality of louvers.

18. The cooking appliance according to claim 15, wherein the second airstream is guided through the at least one opening prior to mixing with the first airstream.

19. The cooking appliance according to claim 15, wherein the first end portion of the diverter means is angled with respect to at least the second end portion.

20. The cooking appliance according to claim 12, further comprising:

a turntable located in the oven cavity; and a motor mounted below the oven cavity for rotating the turntable, said second airstream flowing across the motor.

21. The cooking appliance according to claim 12, further comprising: a second oven cavity located below said oven cavity, said control panel being located vertically between the oven cavity and said second oven cavity, wherein the moisture is directed away from the control panel.

22. The cooking appliance according to claim 12, wherein the predetermined region is located at a front corner portion of the cooking appliance.

23. A method of removing moisture developed during a cooking operation of a food item in an oven cavity of a microwave cooking appliance comprising:

introducing an airflow into the cooking appliance during the cooking operation;

introducing microwave energy into the oven cavity to cook the food item;

directing a first portion of the airflow into the oven cavity;

directing a second portion of the airflow outside the oven cavity;

guiding the first portion of the airflow from the oven cavity to outside the oven cavity, with said first portion including moisture developed in the oven cavity during the cooking operation;

leading the second portion of the airflow through a diverter member to mix with the first portion of the airflow approximately at an exhaust outlet; and exhausting the first and second portions of the airflow away from the cooking appliance through the exhaust outlet, wherein the moisture carried by the first portion of the airflow is carried away from the cooking appliance.

24. The method of claim 23, further comprising: mixing the first and second portions of the airflow below a level of the oven cavity.

25. The method of claim 24, wherein the second portion of the airflow is lead through a plurality of round openings provided in the diverter member.

26. The method of claim 24, wherein the second portion of the airflow is lead through a plurality of louvers provided in the diverter member.

27. The method of claim 23, further comprising:

rotating a turntable located in the oven cavity through a motor mounted below the oven cavity; and directing the second portion of the airflow across the motor.

28. The method of claim 23, further comprising: causing the first and second portions of the airflow to mix at a front corner portion of the cooking appliance.

* * * * *